US006738729B1

(12) United States Patent
Schoch

(10) Patent No.: US 6,738,729 B1
(45) Date of Patent: May 18, 2004

(54) DYNAMIC DIE PENETRATION MONITOR

(75) Inventor: Daniel A. Schoch, Minster, OH (US)

(73) Assignee: The Minster Machine Company, Minster, OH (US)

( * ) Notice: Subject to any disclaimer, the term of this patent is extended or adjusted under 35 U.S.C. 154(b) by 335 days.

(21) Appl. No.: 09/691,678

(22) Filed: Oct. 18, 2000

Related U.S. Application Data

(60) Provisional application No. 60/160,218, filed on Oct. 19, 1999.

(51) Int. Cl.[7] ..... G08B 23/00
(52) U.S. Cl. ..... 702/182
(58) Field of Search ..... 73/81, 82; 702/182, 702/94, 97, 172, 186; 72/21.3, 15, 20, 19.8; 428/27; 100/35; 700/79; 83/13

(56) References Cited

U.S. PATENT DOCUMENTS 3,700,371 A * 10/1972 Edwards et al. ..... 425/144
4,378,717 A * 4/1983 Schneider et al. ..... 83/530
4,429,627 A * 2/1984 Edso ..... 100/35
4,481,847 A * 11/1984 Schneider et al. ..... 83/530
4,621,517 A * 11/1986 Hatanaka et al. ..... 72/441
4,633,720 A * 1/1987 Dybel et al. ..... 73/862
4,987,528 A * 1/1991 O'Brien ..... 700/79
5,090,282 A * 2/1992 Ruesch ..... 83/13
5,140,834 A * 8/1992 Kashiwagi et al. ..... 72/15.2
5,269,163 A * 12/1993 Yagi et al. ..... 72/446
5,297,478 A * 3/1994 Jartyn et al. ..... 100/35
5,423,199 A * 6/1995 Mangrulkar ..... 72/3
5,564,298 A * 10/1996 DeMeo ..... 72/19.8
5,692,404 A * 12/1997 Kirii et al. ..... 72/15.1
6,134,954 A * 10/2000 Suresh et al. ..... 73/81
6,247,355 B1 * 6/2001 Suresh et al. ..... 73/82

* cited by examiner

*Primary Examiner*—John Barlow
*Assistant Examiner*—Tung Lau
(74) *Attorney, Agent, or Firm*—Randall J. Knuth

(57) ABSTRACT

An apparatus and method for monitoring die penetration depth of a mechanical press which does not directly measure die penetration depth is disclosed. Actual slide displacement curves under load conditions are continually generated for the press being monitored. The point at which the slide contacts the stock material, the dynamic die bottom dead center point of the slide, and the material thickness are utilized to compute actual die penetration depth. Additionally, theoretical die penetration depth may be calculated using values of theoretical contact point, theoretical bottom dead center and material hardness. Computed values of actual and theoretical die penetration depth as well as corresponding press operational parameters are stored in a database and provide a means of predicting die penetration depth for a particular operational condition of a mechanical press.

27 Claims, 5 Drawing Sheets

DYNAMIC DIE PENETRATION MONITOR

CROSS-REFERENCE TO RELATED APPLICATIONS

This application relates to and claims the benefit under 35 U.S.C. § 119 of Provisional Application Serial No. 60/160,218 filed Oct. 19, 1999 by the same inventor.

BACKGROUND OF THE INVENTION

1. Field of the Invention

The present invention relates generally to a method and apparatus for monitoring the die penetration depth of a mechanical press. Specifically, the present invention relates to a method and apparatus for monitoring die penetration depth which indirectly measures die penetration depth.

2. Description of the Related Art

Mechanical presses of the type performing stamping and drawing operations employ a conventional construction which includes a frame structure having a crown and a bed and which supports a slide in a manner enabling reciprocating movement toward and away from the bed. These press machines are widely used for a variety of workpiece operations and employ a large selection of die sets with the press machine varying considerably in size and available tonnage depending upon its intended use.

Conventional press machines employ a tooling apparatus in the form of a die assembly to shape a workpiece, such as in a stamping or drawing operation. The die assembly particularly includes a lower die attached to the bed or bolster and an upper die or punch attached to the slide. The upper and lower dies are installed in opposing spaced apart relation to one another and cooperate during press machine operation to mutually engage the workpiece at respective sides thereof to thereby effect the desired forming activity.

Repeated stamping operations of a mechanical press cause die wear. The ability to accurately predict die wear and/or to predict operating conditions which indicate the propensity for increased die wear is advantageous in that press down time for die replacement or reconditioning can be predicted or potentially diverted by proactive early corrective intervention. During press operation, the upper die or punch may continue to penetrate into the lower die after effecting the desired forming activity on the stock material. This continued punch penetration into the lower die contributes to punch or upper die wear. Minimizing die penetration depth will lead to increased die longevity. Minimizing die penetration depth additionally decreases the chance that the upper die or punch will chip or deform.

Upper die or punch penetration into the lower die additionally leads to increased punch wear since upper die penetration leads to additional punch surface area coming into contact with and being worn by stock material. This additional punch penetration leads to additional punch surface area which must be reground when the die is serviced. Having to resurface additional area of the punch is not only time consuming but leads to decreased punch longevity since additional material must be ground away from the punch.

What is needed in the art is a method and apparatus to monitor die penetration depth so that die penetration depth may be minimized and consequently tooling lifetime and maintenance intervals may be more accurately predicted.

SUMMARY OF THE INVENTION

The present invention provides a method and apparatus for monitoring die penetration without requiring a direct measurement thereof. Specifically, the method and apparatus of the present invention utilizes measured quantities such as the contact point where the slide contacts the stock material, the dynamic die bottom dead center point of the slide under a load condition, and stock material thickness to compute a measure of die penetration. Dynamic die bottom dead center is defined as the point furthest from top dead center reached by the die being monitored. The method and apparatus of the current invention additionally creates a database of monitored die penetration, die number, actual running speed of the press, and material specifications including material hardness so that optimum operating conditions of a mechanical press leading to minimum die penetration depth may be determined.

The invention, in one form thereof, comprises a method of monitoring performance parameters for a mechanical press. This method includes the steps of: determining the distance between the contact point and the dynamic die bottom dead center point of the slide during a load condition of the press, determining the stock material thickness, and subtracting the stock material thickness from the determined distance between the contact point and the dynamic die bottom dead center point of the slide to calculate die penetration depth. This method may further include the steps of: providing a computational device, communicating the contact point and the dynamic die bottom dead center point of the slide during a load condition of the press to the computational device, using the computational device to determine the distance between the contact point and the dynamic die bottom dead center point, communicating the stock material thickness to the computational device, and using the computational device to subtract the stock material thickness from the distance between the contact point and the dynamic die bottom dead center point of the slide to determine the die penetration depth.

The step of determining the distance between the contact point and the dynamic die bottom dead center point of the slide during a load condition of the press is achieved in one form of the current invention by generating an actual slide displacement curve during a load condition of the press, determining the contact point on the actual slide displacement curve which corresponds to the slide contacting the stock material, determining the dynamic die bottom dead center point on the actual slide displacement curve, and measuring the distance along the slide path between the contact point and the dynamic die bottom dead center point.

In one form of the current invention, the step of generating an actual slide displacement curve during a load condition of the press is accomplished by monitoring the displacement of the slide of the press and plotting slide displacement vs. a count quantity. The step of plotting slide displacement vs. a count quantity may be accomplished by plotting slide displacement vs. crank angle or by plotting slide displacement vs. time.

In one form of the current invention, the step of determining the contact point on the actual slide displacement curve includes the steps of: determining the first inflection point on the actual slide displacement curve and establishing the contact point on the actual slide displacement curve as the first inflection point on the actual slide displacement curve.

In one form of the current invention, the step of determining the dynamic die bottom dead center point on the actual slide displacement curve includes the steps of: determining the top dead center location of the slide, determining the point on the actual slide displacement curve that is at the greatest distance along the slide path from the top dead center location of the slide, and establishing the dynamic die bottom dead center point on the actual slide displacement curve as the point on the actual slide displacement curve that is at the greatest distance along the slide path from the top dead center location of the slide.

The invention, in another form thereof, comprises a method of monitoring performance parameters for a mechanical press. This method includes the steps of: determining the distance between the contact point and the dynamic die bottom dead center point of the slide during a load condition of the press, determining the stock material thickness, subtracting the stock material thickness from the distance between the contact point and the dynamic die bottom dead center point of the slide to determine the die penetration depth, providing a computer storage device, and inputting variables corresponding to press operational parameters into the computer storage device. The step of inputting variables corresponding to press operational parameters may further include the steps of: inputting a value of die number for the press being monitored, inputting a value of press speed for the press being monitored, inputting values corresponding to the material specifications of the stock material, and inputting computed values of die penetration depth. The step of inputting values corresponding to the material specifications of the stock material may comprise inputting a value of material hardness of the stock material.

The invention, in another form thereof, comprises a method of monitoring performance parameters for a mechanical press. This method includes the steps of: determining the distance between the contact point and the dynamic die bottom dead center point of the slide during a load condition of the press, determining the stock material thickness, subtracting the stock material thickness from the distance between the contact point and the dynamic die bottom dead center point of the slide to determine the die penetration depth, providing a computer storage device, inputting variables corresponding to press operational parameters into the computer storage device, constructing a database of press operational parameters including die penetration values, and determining optimum minimum die penetration conditions for the press being monitored. In one form of the current invention, this method further includes the step of: adjusting the shutheight of the press being monitored in response to the die penetration being experienced by the press being monitored so as to minimize die penetration.

The invention, in another form thereof, comprises a method of monitoring performance parameters for a mechanical press.

This method includes the steps of: determining the location of the stock material surface which is the greatest distance along the slide path from the top dead center position of the slide, determining the location of the dynamic die bottom dead center point of the slide during a load condition of the press, and determining the distance along the slide path between the dynamic die bottom dead center point of the slide during a load condition of the press and the stock material surface which is the greatest distance along the slide path from the top dead center position of the slide to determine die penetration depth. In one form of the current invention, this method further includes the steps of: providing a computational device, communicating the location of the stock material surface which is the greatest distance along the slide path from the top dead center position of the slide to the computational device, communicating the location of the dynamic die bottom dead center point of the slide during a load condition of the press to the computational device, and using the computational device to determine the distance along the slide path between the dynamic die bottom dead center point of the slide during a load condition of the press and the stock material surface which is the greatest distance along the slide path from the top dead center position of the slide to determine die penetration depth.

The invention, in another form thereof, comprises a method of monitoring performance parameters for a mechanical press. This method includes the steps of: determining the location of the stock material surface which is the greatest distance along the slide path from the top dead center position of the slide, determining the location of the dynamic die bottom dead center point of the slide during a load condition of the press, and determining the distance along the slide path between the dynamic die bottom dead center point of the slide during a load condition of the press and the stock material surface which is the greatest distance along the slide path from the top dead center position of the slide to determine die penetration depth. In one form of the current invention, the step of determining the location of the stock material surface which is the greatest distance along the slide path from the top dead center position of the slide includes the steps of: choosing a reference point, determining the contact point height relative to the chosen reference point, determining the stock material thickness, and subtracting the stock material thickness from the contact point height to determine the height of the stock material surface which is the greatest distance along the slide path from the top dead center position of the slide relative to the chosen reference point.

In one form of the current invention, the step of determining the contact point height relative to the chosen reference point includes the steps of: generating an actual slide displacement curve during a load condition of the press; determining the first inflection point on the actual slide displacement curve; establishing the contact point on the actual slide displacement curve as the first inflection point on the actual slide displacement curve; and determining the distance, along the slide path, between the contact point and the chosen reference point.

In one form of the current invention, the step of determining the location of the dynamic die bottom dead center point of the slide during a load condition of the press comprises determining the dynamic die bottom dead center point height relative to the chosen reference point. The step of determining the dynamic die bottom dead center point height relative to the chosen reference point may further includes the steps of: determining the top dead center location of the slide; determining the point on the actual slide displacement curve that is at the greatest distance from the top dead center location of the slide; establishing the dynamic die bottom dead center point on the actual slide displacement curve as the point on the actual slide displacement curve that is at the greatest distance from the top dead center location of the slide; and determining the distance, along the slide path, between the dynamic die bottom dead center point and the chosen reference point.

In one form of the current invention, the step of determining the distance along the slide path between the dynamic die bottom dead center point of the slide during a load condition of the press and the stock material surface which is the greatest distance along the slide path from the top dead center position of the slide to determine die penetration depth includes the step of: determining the distance between the height of the stock material surface which is the greatest distance along the slide path from the top dead center position of the slide and the height of the dynamic die bottom dead center point to determine the die penetration depth.

The invention, in another form thereof, comprises an apparatus for monitoring a running press. The apparatus of this form of the current invention includes an input means for inputting a plurality of input values, which include a value of material thickness corresponding to the stock material being utilized. The apparatus of this form of the current invention further includes a computational device for computing a plurality of computed values including a measure of die penetration depth. The input means are communicatively connected to the computational device so that input values may be utilized in the computational device. A non-contact displacement sensor is utilized to sense slide displacement during an actual load condition of the press. The non-contact displacement sensor is communicatively connected to the computational device so that the computational device is operable to plot sensed slide displacement vs. a count quantity. Slide displacement vs. count quantity is plotted to generate an actual slide displacement curve. The count quantity can be a measure of time or crank angle. The computational device is operable to determine the contact point on the actual slide displacement curve which contact point corresponds to the slide contacting the stock material. The computational device additionally determines the dynamic die bottom dead center point on the actual slide displacement curve. The computational device utilizes the contact point, the dynamic die bottom dead center point, and the stock material thickness to compute a value of die penetration depth. The computational device can be, for example, a microprocessor.

The plurality of input values input via the input means can include a value corresponding to the die number for the press being monitored and a plurality of values corresponding to the specifications of the stock material being utilized in the press, including a value of stock material hardness.

A speed sensor may additionally be utilized to sense a value of press operational speed. The speed sensor is communicatively connected to the computational device. In one form of the current invention, a computer storage device is communicatively connected to the computational device and is operative to store the plurality of computed values, the plurality of input values, and the monitored value of press speed. The computer storage device is operable to create a database of the input and computed values, as well as the value of press speed.

The invention, in another form thereof, comprises a method of monitoring performance parameters for a mechanical press. This method includes the steps of: generating a theoretical no-load slide displacement curve for the press, determining the theoretical contact point on the theoretical no-load slide displacement curve, determining the theoretical bottom dead center point on the theoretical no-load slide displacement curve, determining the distance between the theoretical contact point and the theoretical bottom dead center point, determining the stock material thickness, and subtracting the stock material thickness from said distance.

In one embodiment, the step of determining the theoretical contact point on the theoretical no-load slide displacement curve comprises: generating an actual slide displacement curve during a load condition of the press, determining the contact point on the actual slide displacement curve which corresponds to the slide contacting the stock material, superimposing the theoretical no-load slide displacement curve and the actual slide displacement curve, determining the contact point on the actual slide displacement curve, determining the point on the downstroke of the theoretical no-load slide displacement curve which maintains the same location along the ordinate as the contact point, and establishing the point on the downstroke of the theoretical no-load slide displacement curve corresponding to the actual contact point as the theoretical contact point.

An advantage of the present invention is the ability to monitor die penetration depth without directly measuring die penetration depth.

Another advantage of the present invention is the ability to monitor die penetration depth utilizing a slide displacement curve which slide displacement curve may additionally be utilized to determine various other press operational parameters.

Yet another advantage of the present invention is the ability to minimize die penetration and therefore minimize punch chipping.

A further advantage of the present invention is the ability to monitor tooling performance and predict and schedule tooling maintenance, e.g. punch sharpening.

Yet another advantage of the present invention is the ability to predict press operational characteristics which will minimize die penetration depth.

Yet another advantage of the present invention is the ability to minimize punch surface area that contacts the stock material and to consequently decrease punch wear.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 2:
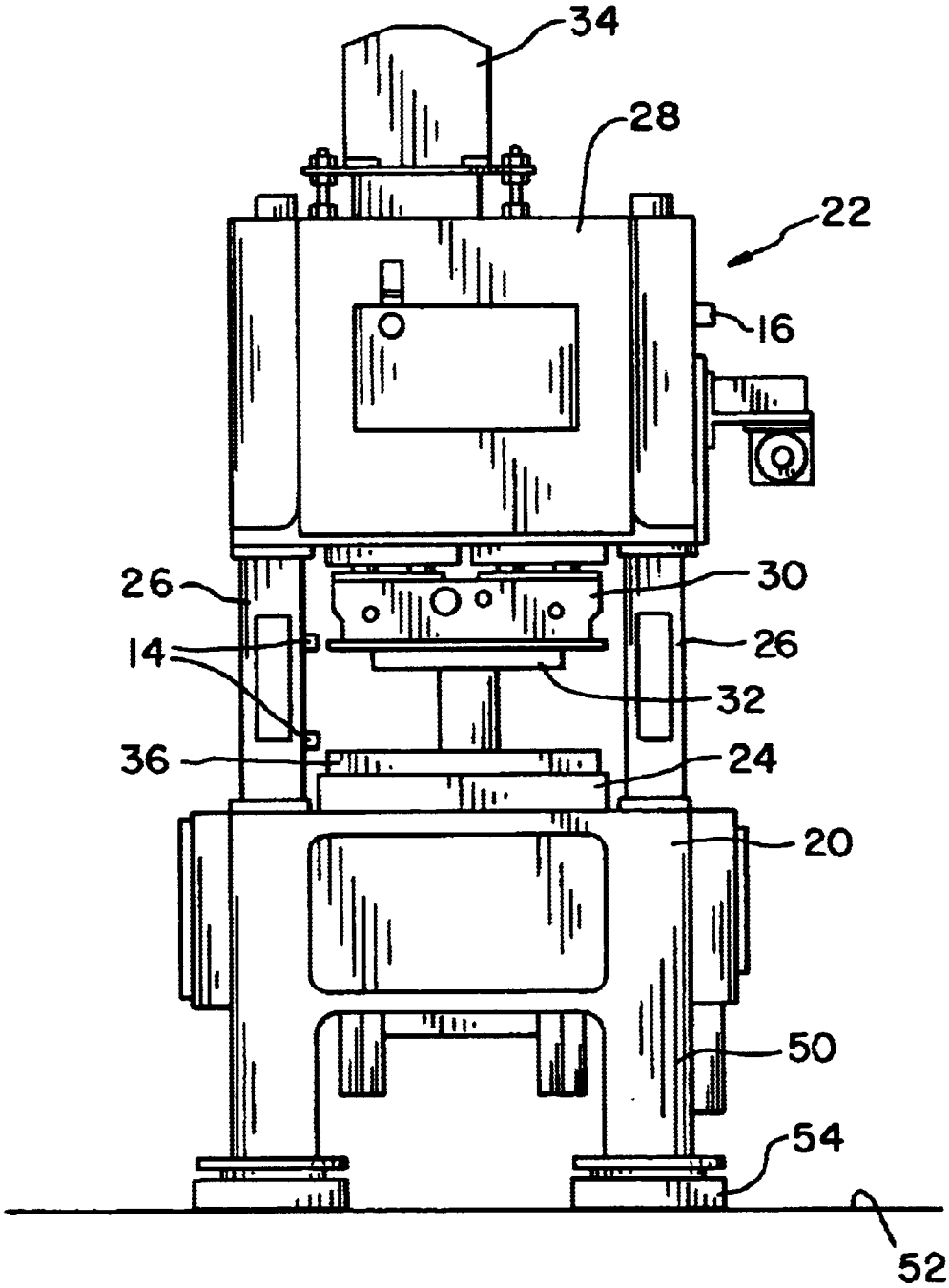
FIG. 2 is an elevational view of a typical press which is the subject of die penetration monitoring.

Referring now to the drawings and particularly to FIG. 2, there is depicted a typical press 22 having a bed 20 with a bolster 24. Attached vertically to bed 20 are uprights 26 which support crown 28. Above crown 28 and attached thereto is press motor 34. Slide 30 is operatively connected so that during operation, press motor 34 causes slide 30 to reciprocate in rectilinear fashion toward and away from bed 20. Upper tooling 32 is operatively connected to slide 30. Lower tooling 36 is operatively connected to bolster 24. Leg members 50 are formed as an extension of bed 20 and are generally mounted to shop floor 52 by means of shock absorbing pads 54.

Generally, the present invention utilizes operational parameters of a mechanical press to determine the die penetration depth being experienced by the press being monitored. Specifically, values of contact height, dynamic die bottom dead center, and material thickness are utilized to compute a value of die penetration depth. Dynamic die bottom dead center is a positional value which indicates the point furthest from top dead center reached by the die being monitored. Values of actual die penetration depth as well as theoretical die penetration depth may be utilized as useful press operational parameters. A computational device may by utilized to perform this computation and a storage device is utilized to record calculated values of die penetration depth as well as press operational parameters such as die number, actual running speed, and stock material specifications including stock material hardness.

Figure 1:
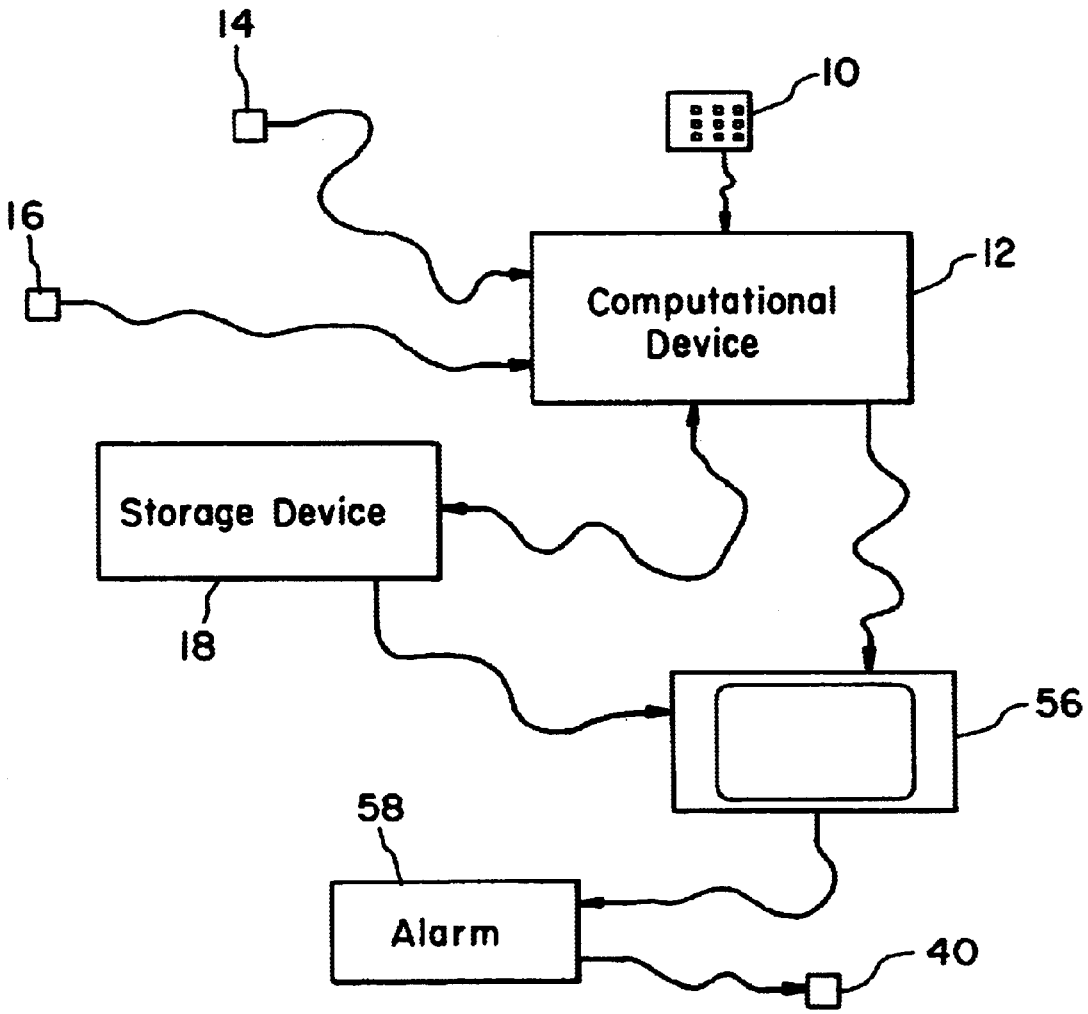
FIG. 1 is a schematic representation of an embodiment of the punch penetration monitoring apparatus.

FIG. 1 illustrates one embodiment of the current invention, wherein computational device 12 receives sensed position values from non-contact displacement sensor 14. Non-contact displacement sensor 14 can be, for example, a hall effect sensor. Computational device 12 further receives a value of press speed (spm) from speed sensor 16. Non-contact displacement sensor 14 and speed sensor 16 are communicatively connected to computational device 12. Input means 10 are also communicatively connected to computational device 12 and are utilized to input press operational parameters such as die number and stock material specifications including stock material thickness and hardness.

Computational device 12 continuously receives input from non-contact displacement sensor 14 and utilizes this information in conjunction with input material thickness values to generate a value of actual die penetration depth for a particular die or dies being monitored for each slide stroke of the press being monitored. Computational device 12 additionally receives a value of press speed (spm) measured by speed sensor 16 as well as press operational parameters input via input means 10. Computational device 12 communicates calculated values of die penetration depth as well as measured values of press speed, and input press operational parameters to storage device 18. Storage device 18 is useful to create a database of computed die penetration values as well as the corresponding press operational parameters for the press being monitored and the speed of the press at the time the die penetration depth is calculated. Computational device 12 may additionally be utilized to generate theoretical no-load slide displacement curves and to superimpose such a theoretical no-load slide displacement curve with a generated actual slide displacement curve so that theoretical die penetration depth may be determined. Generation of a theoretical no-load slide displacement curve as well as a curve matching technique utilized to superimpose an actual slide displacement curve and a theoretical no-load slide displacement curve is disclosed in U.S. patent application Ser. No. 09/678,183, filed Oct. 2, 2000 entitled DISPLACEMENT BASED DYNAMIC LOAD MONITOR which assigned to the assignee of the current invention, the disclosure of which is herein explicitly incorporated by reference.

Display 56 is directly communicatively connected to computational device 12 and storage device 18 and may be utilized to display computed values of actual or theoretical die penetration depth as well as press operational characteristics and other information stored in storage device 18. Display 56 is further communicatively connected to alarm 58. Alarm 58 may be utilized to signal a press operator that the calculated die penetration depth for a pressing cycle of a press being monitored is outside a predefined acceptable range of die penetration depth. The press operator may then adjust the shutheight of the press being monitored to return the die penetration depth to an acceptable value. In one embodiment, alarm 58 is communicatively connected to automatic shutheight adjustment device 40. In this embodiment, automatic shutheight adjustment device 40 will automatically adjust the shutheight of the press being monitored in response to a calculated measure of die penetration depth which is outside a predefined acceptable range. Shutheight adjustment devices known in the art include those disclosed in U.S. Pat. Nos. 5,761,971; 5,682,813; 5,456,165; 5,398,601; and 5,285,722.

During press operation, non-contact displacement sensor 14 continually monitors and communicates slide displacement values to computational device 12. Computational device 12 utilizes the thusly communicated slide displacement values from non-contact displacement sensor 14 to continually generate actual slide displacement curves for each slide stroke of the press being monitored. An example of an actual slide displacement curve is depicted in FIG. 3.

Figure 3:
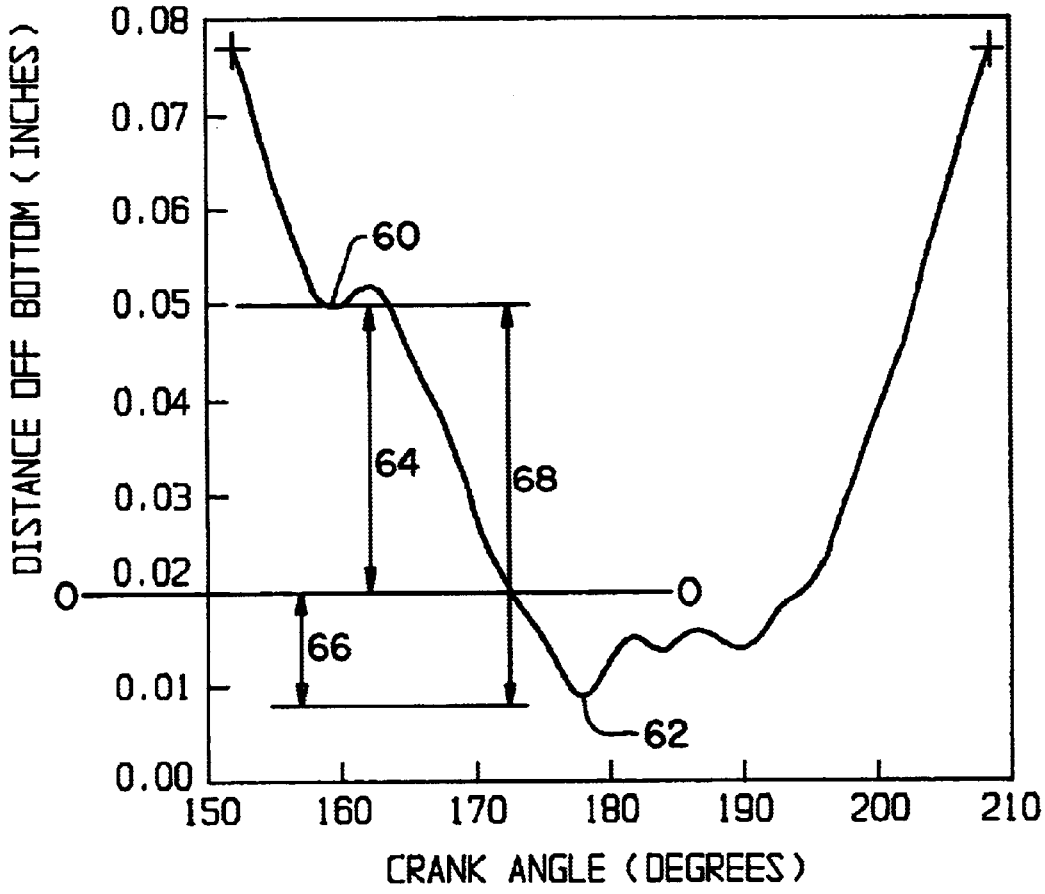
FIG. 3 is a graphical representation of an actual slide displacement curve.
Figure 4:
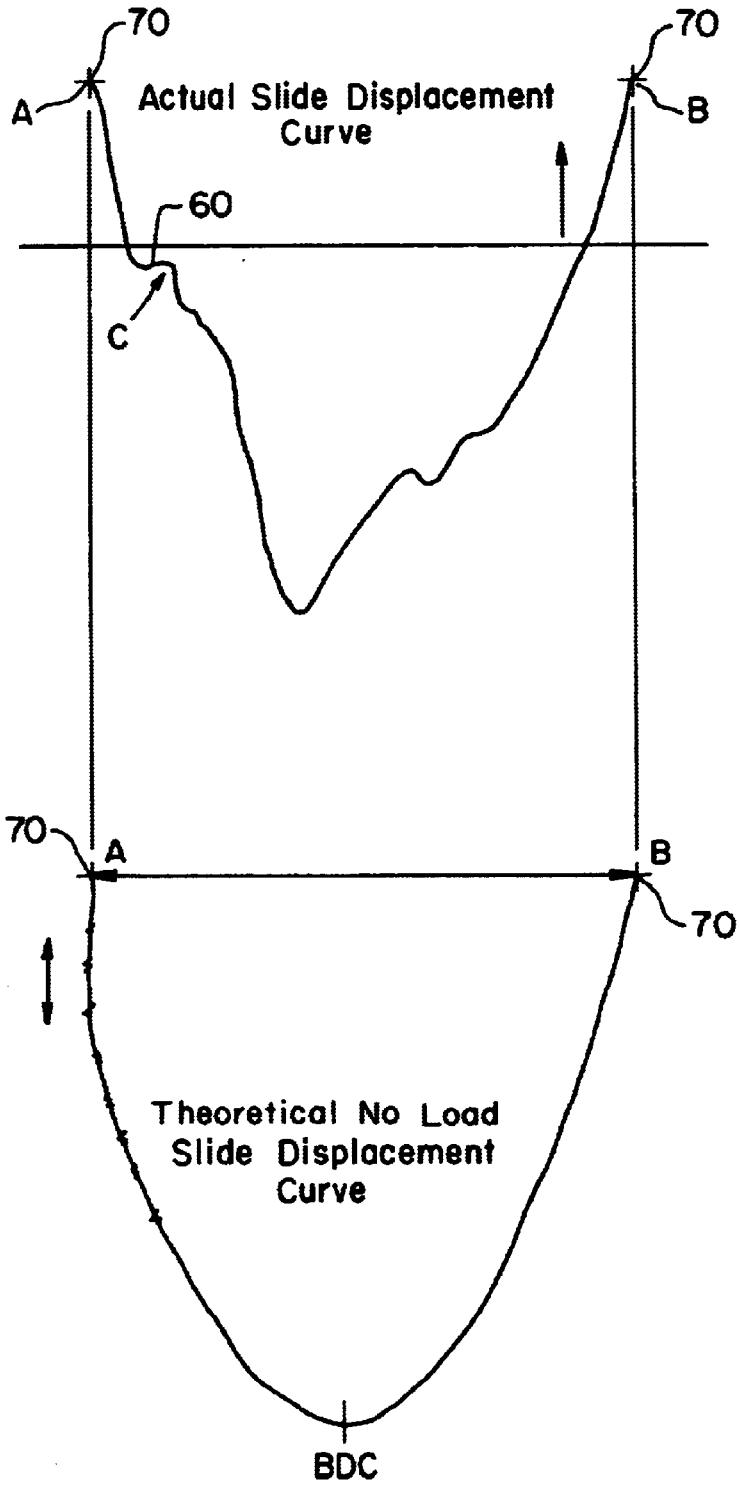
FIG. 4 is a graphical representation of an actual slide displacement curve and a theoretical no-load slide displacement curve.

As illustrated in FIG. 3, contact point 60 may be identified on an actual slide displacement curve as the first inflection point. Contact point 60 signals the slide position where the slide first contacts the stock material and is characterized by an inflection point due to the "bounce" experienced as the slide or associated slide element such as a stripper plate contacts the stock material. Dynamic die bottom dead center point 62 is characterized as the point on the actual slide displacement curve which is furthest from top dead center. Computational device 12 continually identifies contact point 60 as the first inflection point on the slide downstroke, as well as dynamic die bottom dead center point 62 for each slide stroke of the press being monitored. Dynamic die bottom dead center point 62 is the point furthest from top dead center reached by the distal most portion of the die being monitored. FIG. 4 illustrates top dead center point 70 on both on actual slide displacement curve and a theoretical no-load slide displacement curve. FIG. 3 illustrates an embodiment of the current invention utilizing an actual slide displacement curve to determine actual die penetration depth 66. Computational device 12 utilizes contact point 60, dynamic die bottom dead center point 62 and stock material thickness 64 to calculate a measure of actual die penetration depth 66. In one embodiment, computational device 12 determines the distance 68 between contact point 60 and dynamic die bottom dead center point 62 and subtracts stock material thickness 64 from this quantity to determine die penetration depth 66. In another embodiment, computational device 12 determines the location of the surface of the stock material furthest from the top dead center position of the slide, i.e. the side of the stock material contacting the lower die (line 0—0); determines the dynamic die bottom dead center position of the slide; and establishes the distance 68, along the slide path, between these two points as the die penetration depth.

Figure 5:
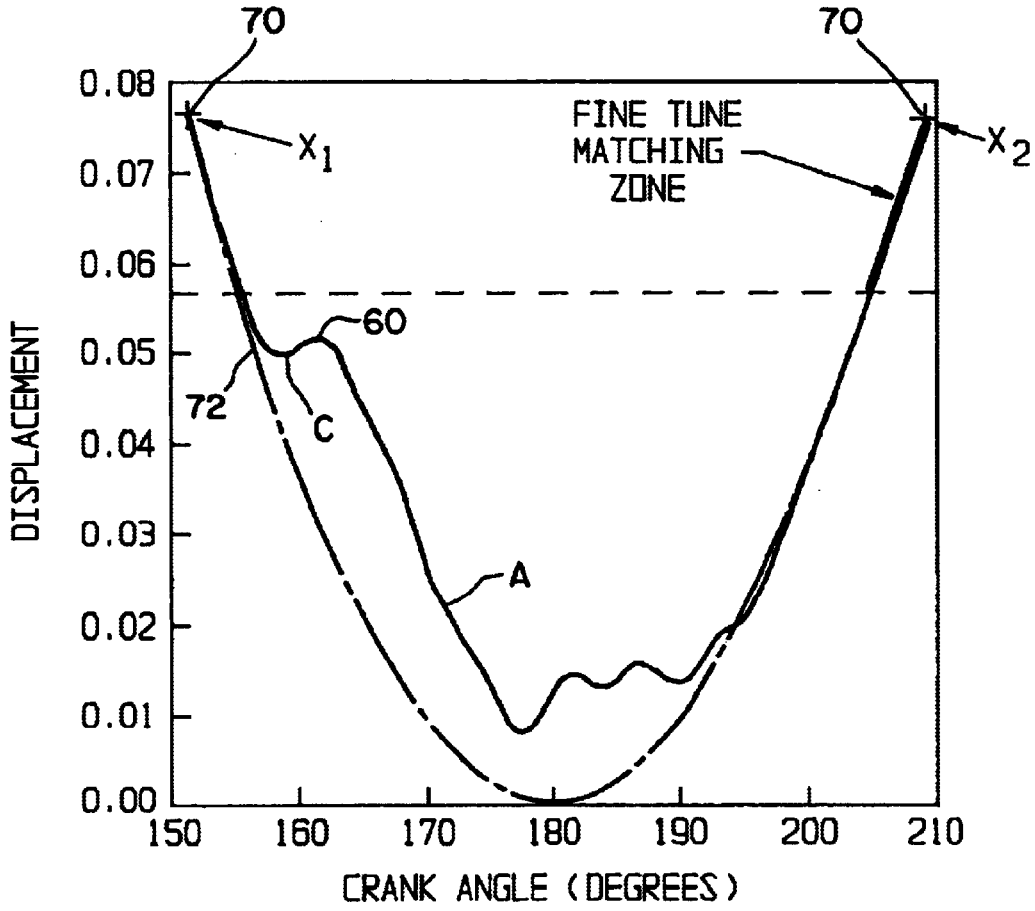
FIG. 5 is a graphical representation of a theoretical no-load slide displacement curve superimposed with an actual slide displacement curve.

FIG. 5 illustrates an actual slide displacement curve superimposed with a theoretical no-load slide displacement curve. Contact point 60 on the actual slide displacement curve is utilized in one embodiment of the current invention to determine theoretical contact point 72. Theoretical contact point 72 is on the slide downstroke and shares the ordinate position of contact point 60. Theoretical contact point 72 may then be utilized in conjunction with stock material thickness to determine a theoretical die penetration depth. Computation of theoretical die penetration depth is performed similarly to the computation of actual die penetration depth and a discussion of the particulars of this computation is omitted here for the sake of brevity.

The database of information constructed in storage device 18 may be utilized to determine optimum press operational characteristics necessary to achieve minimum die penetration depth for a particular stock material hardness, die number, and/or press speed. Information obtained in this way provides an excellent predictor of die penetration depth for a particular press being monitored and as such is helpful in configuring a press so as to produce minimum die penetration. Computational device 12 may further be connected to a modem or otherwise to a remote location where press operational condition may be usefully communicated.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of monitoring performance parameters for a mechanical press, comprising:

determining the distance between the contact point and the dynamic die bottom dead center point of the slide during a load condition of the press;

determining the stock material thickness; and subtracting the stock material thickness from said determined distance to calculate the die penetration depth.

2. The method of claim 1, further comprising:

providing a computational device;

communicating the contact point and the dynamic die bottom dead center point of the slide during a load condition of the press to the computational device;

using the computational device to determine the distance between the contact point and the dynamic die bottom dead center point;

communicating the stock material thickness to the computational device; and using the computational device to subtract the stock material thickness from the distance between the contact point and the dynamic die bottom dead center point of the slide to determine the die penetration depth.

3. The method of claim 1, wherein said step of determining the distance between the contact point and the dynamic die bottom dead center point of the slide during a load condition of the press comprises:

generating an actual slide displacement curve during a load condition of the press;

determining the contact point on the actual slide displacement curve which corresponds to the slide contacting the stock material;

determining the dynamic die bottom dead center point on the actual slide displacement curve; and measuring the distance along the slide path between the contact point and the dynamic die bottom dead center point.

4. The method of claim 3, wherein said step of generating an actual slide displacement curve during a load condition of the press comprises:

monitoring the displacement of the slide of the press; and plotting slide displacement vs. a count quantity.

5. The method of claim 4, wherein said step of plotting slide displacement vs. a count quantity comprises plotting slide displacement vs. crank angle.

6. The method of claim 4, wherein said step of plotting slide displacement vs. a count quantity comprises plotting slide displacement vs. time.

7. The method of claim 3, wherein said step of determining the contact point on the actual slide displacement curve comprises:

determining the first inflection point on the actual slide displacement curve; and establishing the contact point on the actual slide displacement curve as the first inflection point on the actual slide displacement curve.

8. The method of claim 3, wherein said step of determining the dynamic die bottom dead center point on the actual slide displacement curve comprises:

determining the top dead center location of the slide;

determining the point on the actual slide displacement curve that is at the greatest distance along the slide path from the top dead center location of the slide; and establishing the dynamic die bottom dead center point on the actual slide displacement curve as the point on the actual slide displacement curve that is at the greatest distance along the slide path from the top dead center location of the slide.

9. The method of claim 1, further comprising:

providing a computer storage device; and inputting variables corresponding to press operational parameters into the computer storage device.

10. The method of claim 9, wherein said step of inputting variables corresponding to press operational parameters comprises:

inputting a value of die number for the press being monitored;

inputting a value of press speed for the press being monitored;

inputting values corresponding to the material specifications of the stock material; and inputting computed values of die penetration depth.

11. The method of claim 10, wherein said step of inputting values corresponding to the material specifications of the stock material comprises inputting a value of material hardness of the stock material.

12. The method of claim 10, further comprising:

constructing a database of press operational parameters including die penetration values; and determining optimum minimum die penetration conditions for the press being monitored.

13. The method of claim 12, further comprising:

adjusting the shutheight of the press being monitored in response to the die penetration being experienced by the press being monitored.

14. A method of monitoring performance parameters for a mechanical press, comprising:

determining the location of the stock material surface the greatest distance along the slide path from the top dead center position of the slide;

determining the location of the dynamic die bottom dead center point of the slide during a load condition of the press; and determining the distance along the slide path between the dynamic die bottom dead center point of the slide during a load condition of the press and the stock material surface the greatest distance along the slide path from the top dead center position of the slide to determine die penetration depth.

15. The method of claim 14, further comprising:

providing a computational device;

communicating the location of the stock material surface the greatest distance along the slide path from the top dead center position of the slide to the computational device;

communicating the location of the dynamic die bottom dead center point of the slide during a load condition of the press to the computational device; and using the computational device to determine the distance along the slide path between the dynamic die bottom dead center point of the slide during a load condition of the press and the stock material surface the greatest distance along the slide path from the top dead center position of the slide to determine die penetration depth.

16. The method of claim 14, wherein said step of determining the location of the stock material surface the greatest distance along the slide path from the top dead center position of the slide comprises:

choosing a reference point;

determining the contact point height relative to the chosen reference point;

determining the stock material thickness; and subtracting the stock material thickness from the contact point height to determine the height of the stock material surface the greatest distance along the slide path from the top dead center position of the slide relative to the chosen reference point.

17. The method of claim 16, wherein said step of determining the contact point height relative to the chosen reference point comprises:

generating an actual slide displacement curve during a load condition of the press;

determining the first inflection point on the actual slide displacement curve;

establishing the contact point on the actual slide displacement curve as the first inflection point on the actual slide displacement curve; and determining the distance, along the slide path, between the contact point and the chosen reference point.

18. The method of claim 17, wherein said step of determining the location of the dynamic die bottom dead center point of the slide during a load condition of the press comprises determining the dynamic die bottom dead center point height relative to the chosen reference point.

19. The method of claim 18, wherein said step of determining the dynamic die bottom dead center point height relative to the chosen reference point comprises:

determining the top dead center location of the slide;

determining the point on the actual slide displacement curve that is at the greatest distance from the top dead center location of the slide;

establishing the dynamic die bottom dead center point on the actual slide displacement curve as the point on the actual slide displacement curve that is at the greatest distance from the top dead center location of the slide; and determining the distance, along the slide path, between the dynamic die bottom dead center point and the chosen reference point.

20. The method of claim 19, wherein said step of determining the distance along the slide path between the dynamic die bottom dead center point of the slide during a load condition of the press and the stock material surface the greatest distance along the slide path from the top dead center position of the slide to determine die penetration depth comprises:

determining the distance between the height of the stock material surface the greatest distance along the slide path from the top dead center position of the slide and the height of the dynamic die bottom dead center point to determine the die penetration depth.

21. An apparatus for monitoring a running press, comprising:

input means for inputting a plurality of input values, said plurality of input values including a value of material thickness corresponding to the stock material being utilized;

a computational device for computing a plurality of computed values, said input means communicatively connected to said computational device, wherein one of said plurality of computed values is a measure of die penetration depth; and a non-contact displacement sensor for sensing slide displacement during an actual load condition of the press, said non-contact displacement sensor communicatively connected to said computational device, said computational device plotting sensed slide displacement vs. a count quantity to generate an actual slide displacement curve, said computational device determining the contact point on the actual slide displacement curve which corresponds to the slide contacting the stock material, said computational device determining the dynamic die bottom dead center point on the actual slide displacement curve, said computational device utilizing the contact point, the dynamic die bottom dead center point and the stock material thickness to compute a value of die penetration depth.

22. The apparatus as recited in claim 21, wherein said computational device comprises:

a microprocessor.

23. The apparatus as recited in claim 21, wherein said plurality of input values comprises:

a value corresponding to the die number for the press being monitored; and a plurality of values corresponding to the specifications of the stock material being utilized in the press, said plurality of values corresponding to the specifications of the stock material including a value of stock material hardness.

24. The apparatus as recited in claim 23, further comprising:

a speed sensor for sensing a value of press speed, said speed sensor communicatively connected to said computational device.

25. The apparatus as recited in claim 24, further comprising:

a computer storage device for storing said plurality of computed values, said plurality of input values and said value of press speed; said computer storage device communicatively connected to said computational device; said computer storage device being operable to create a database of said input values, said computed values and said value of press speed.

26. A method of monitoring performance parameters for a mechanical press, comprising:

generating a theoretical no-load slide displacement curve for the press;

determining the theoretical contact point on the theoretical no-load slide displacement curve;

determining the theoretical bottom dead center point on the theoretical no-load slide displacement curve;

determining the distance between the theoretical contact point and the theoretical bottom dead center point;

determining the stock material thickness; and subtracting the stock material thickness from said distance.

27. The method of claim 26, wherein said step of determining the theoretical contact point on the theoretical no-load slide displacement curve comprises:

generating an actual slide displacement curve during a load condition of the press;

determining the contact point on the actual slide displacement curve which corresponds to the slide contacting the stock material;

superimposing the theoretical no-load slide displacement curve and the actual slide displacement curve;

determining the contact point on the actual slide displacement curve;

determining the point on the downstroke of the theoretical no-load slide displacement curve which maintains the same location along the ordinate as the contact point; and establishing the point on the downstroke of the theoretical no-load slide displacement curve corresponding to the actual contact point as the theoretical contact point.

* * * * *